US010758042B2

(12) United States Patent
Smith

(10) Patent No.: US 10,758,042 B2
(45) **Date of Patent: *Sep. 1, 2020**

(54) UNIVERSAL DRAWER SLIDE

(71) Applicant: Austin Hardware and Supply, Inc., Lee's Summit, MO (US)

(72) Inventor: Norman Allen Smith, Buford, GA (US)

(73) Assignee: AUSTIN HARDWARE AND SUPPLY, INC., Lee's Summit, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/515,235

(22) Filed: Jul. 18, 2019

(65) Prior Publication Data

US 2019/0335902 A1 Nov. 7, 2019

Related U.S. Application Data

(63) Continuation of application No. 15/883,193, filed on Jan. 30, 2018, now Pat. No. 10,362,870.

(51) Int. Cl.

| | |
|---|---|
| ***A47B 88/423*** | (2017.01) |
| ***A47B 88/407*** | (2017.01) |
| ***A47B 88/53*** | (2017.01) |
| ***A47B 88/50*** | (2017.01) |

(52) U.S. Cl.

CPC ..... *A47B 88/423* (2017.01); *A47B 88/407* (2017.01); *A47B 88/50* (2017.01); *A47B 88/53* (2017.01); *A47B 2088/4235* (2017.01)

(58) Field of Classification Search

CPC ..... A47B 88/423; A47B 88/407; A47B 88/44; A47B 88/443; A47B 88/447; A47B 88/49

See application file for complete search history.

(56) References Cited

U.S. PATENT DOCUMENTS

| | | | | |
|---|---|---|---|---|
| 6,817,685 | B2 * | 11/2004 | Lammens | A47B 88/493 312/333 |
| 8,317,278 | B2 * | 11/2012 | Enos | A47B 88/493 312/333 |
| 10,362,870 | B1 * | 7/2019 | Smith | A47B 88/407 |
| 2008/0278048 | A1 * | 11/2008 | Burgess, III | A47B 88/49 312/333 |
| 2010/0039009 | A1 * | 2/2010 | Chen | A47B 88/423 312/334.2 |
| 2010/0040313 | A1 * | 2/2010 | Juang | A47B 88/49 384/21 |

(Continued)

OTHER PUBLICATIONS

PCT/US2019/015425 International Search Report and Written Opinion dated Mar. 4, 2019; (7 pages).

(Continued)

*Primary Examiner* — Daniel J Rohrhoff

(74) *Attorney, Agent, or Firm* — Polsinelli PC

(57) ABSTRACT

A universal drawer slide is described. The drawer slide includes an outer slide member and an inner slide member that are configured to move between a closed position and an extended position. A lever is pivotally mounted to a front portion of the inner slide member. A cam mounts to the outer side member in at least a first position and a second position. An engaging end of the lever engages with the cam in either the first position or the second position.

26 Claims, 16 Drawing Sheets

(56) References Cited

U.S. PATENT DOCUMENTS

2016/0060934 A1* 3/2016 Chen ..... A47B 88/44
16/96 R

OTHER PUBLICATIONS

Accuride "Movement Solutions for Industrial & Electromechanical Applications", catalog, May 2016 (44 pages).
Accuride "Accuride "9308 Heavy-Duty Lock-in/Lock-out Slide", brochure, Sep. 2013 (2 pages).

* cited by examiner

UNIVERSAL DRAWER SLIDE

CROSS REFERENCE TO RELATED APPLICATION

This application is a continuation of U.S. patent application Ser. No. 15/883,193 filed Jan. 30, 2018, which is hereby incorporated by reference.

FIELD OF INVENTION

The present invention relates to a universal drawer slide.

BACKGROUND OF THE INVENTION

Certain drawer slides used in cabinets and other storage systems include both a lock-in and a lock-out feature. The lock-in feature reduces accidental opening by requiring the user to unlatch the drawer slide before opening a drawer, tray, panel, or other sliding or storage member that is engaged or attached to the drawer slide. The lock-out feature maintains the drawer in the open position and also requires the user to further unlatch the drawer slide before closing the drawer. Drawer slides having both lock-in and lock-out features are often used in emergency and commercial vehicles where it is important to maintain drawers and storage members in a closed position during transit and to further maintain the drawers or storage members in an opened position once the drawers are opened. For example, the parking of emergency and commercial vehicles on an incline could cause the inadvertent closure of a drawer that does not lock-out.

Typical drawer slides that lock-in and lock-out require both a left hand drawer slide for a left side of a cabinet and a separate right hand drawer slide for a right side of the cabinet in order for release levers of each slide to operate in the same direction, e.g., in an upwards or in a downwards direction. This requirement for separate left and right drawer-slides increases inventory, stocking costs, labor, etc.

SUMMARY OF INVENTION

A universal drawer slide is described. The universal drawer slide may be mounted on either a left side or a right side of a cabinet or other storage system, which provides the universal nature of the slide of the present disclosure. The universal drawer slide may include both lock-in and lock-out features. In order to switch usage between the right side and the left side, an operator needs to adjust an orientation of a cam which is mounted on the slide. The slide includes at least two different mounting positions for the cam. Thus, a pair of the same slides may be used for the left and rights sides of a drawer or other storage member with only the adjustment of the cam. For example, after installation of the right drawer slide, the left drawer slide is rotated approximately 180 degrees along it major axis relative to the right drawer slide, the cam position of the left drawer slide is adjusted to have the same angle as the right drawer slide, and the left drawer slide is installed.

The universal slide mechanism will allow both a lever of the right hand slide and a lever of the left hand slide to operate either up or down to release a lock-in mechanism to open the respective slide. Further, the same lever will release a further lock-out mechanism in order to allow the drawer to close. In order to use the slide on a second, opposite side, the position and/or orientation of the cam is moved to be the same as the first side. When installed, both levers of the left and right sides will operate in the same direction—for example either upwards or downwards.

In some storage applications, a lock-in/lock-out drawer slide is only used on one side of the cabinet or the storage system. The universal slide mechanism may be used on either side of the cabinet or the storage system in conjunction with a non-locking drawer slide on the opposite side.

DETAILED DESCRIPTION OF INVENTION

Figure 1:
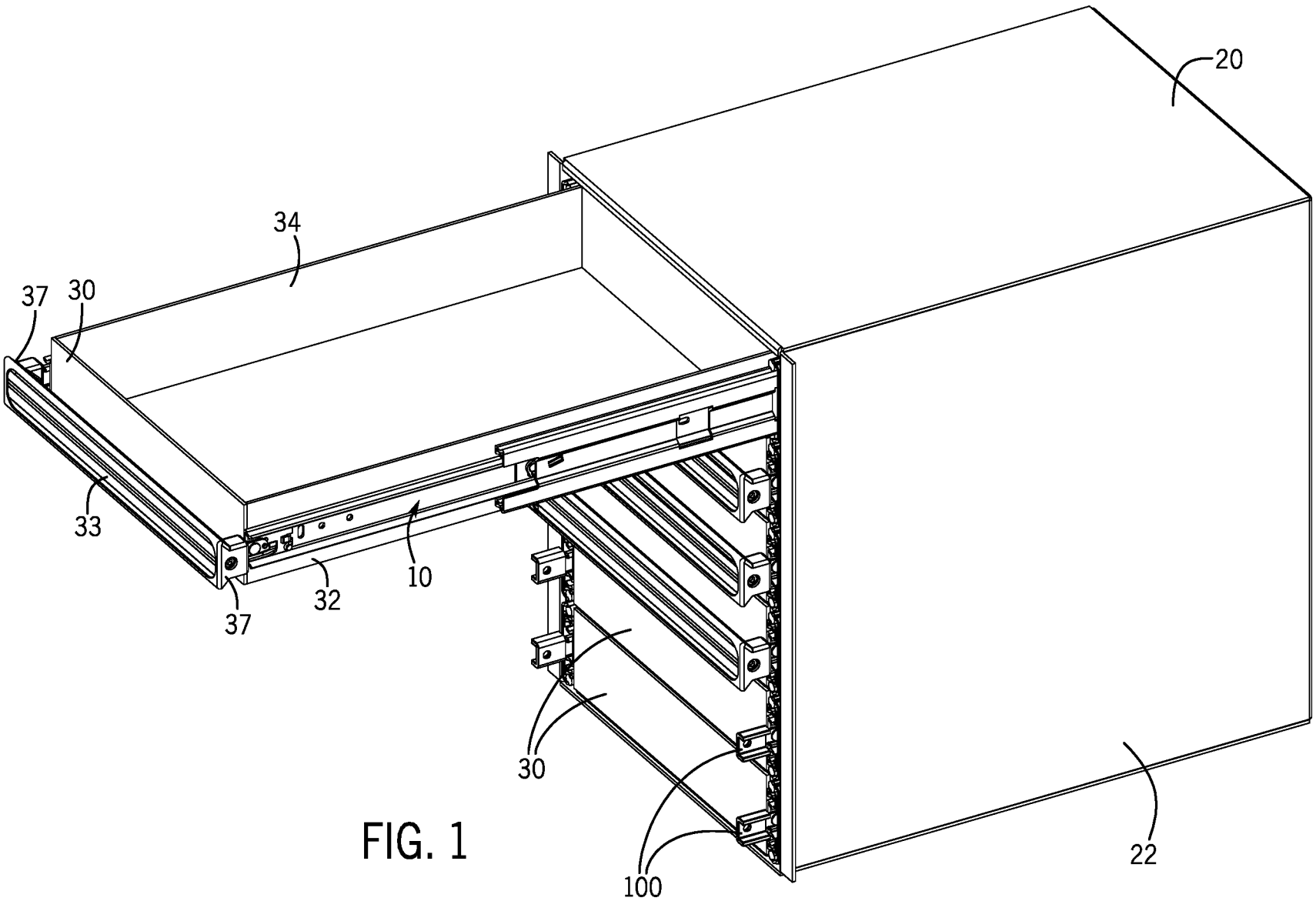
FIG. 1 is a perspective view of the cabinet with drawers engaged to the cabinet via universal drawer slides.
Figure 2:
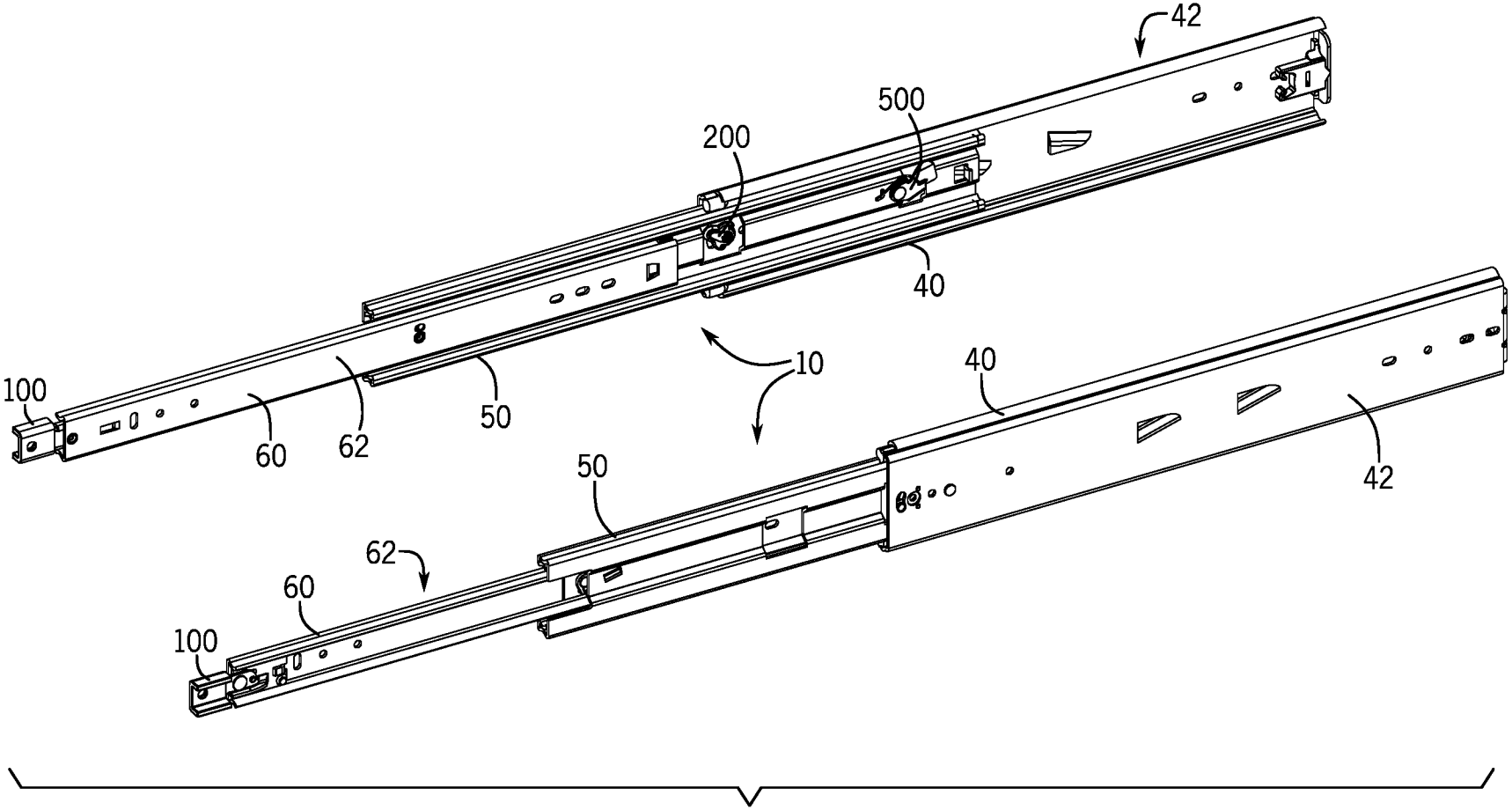
FIG. 2 includes perspective views of the universal drawer slides in the opened position.

A universal slide 10 will now be described with reference to FIGS. 1-19. As shown in FIG. 1, the universal drawer slide 10 is generally mounted to interior walls of or other mounting structures of a cabinet 20. The universal drawer slide 10 provides for drawers 30 to slide in an out of the cabinet 20. In the aspect shown in FIG. 2, the universal drawer slide 10 includes an outer slide member 40, a middle slide member 50, and an inner slide member 60 in a telescoping/extending arrangement that provides for the drawers 30 to move between open and closed positions. In other aspects, only an outer slide member and an inner slide member are employed.

Typically, the universal drawer slides 10 are mounted on both a right side 32 and a left side 34 of the drawer 30. The universal drawer slides 10 mounted on the right side 32 and the left side 34 of the drawer 30 may be substantially identical except for a position of a cam 200. Relative to each other, the universal drawer slides 10 mounted on the right side 32 and the left side 34 of the drawer 30 have been rotated approximately 180 degrees, which requires the herein described adjustment of the position of the cam 200. In FIGS. 1-19, the universal drawer slide 10 is mounted in a vertical orientation. In other aspects, the universal drawer slide 10 may be rotated 90 degrees and mounted in a horizontal orientation With respect to FIGS. 1 and 2, an exterior surface 42 of the outer slide member 40 is affixed to an interior of a wall 22 of the cabinet 20. An interior surface 62 of the inner slide member 60 is affixed to the side surface 32 or 34 of the drawer 30. The universal drawer slides 10 provide for the drawer 30 to slide in and out of the cabinet 20. Of course, the outer side member 40 may also be mounted to supports or structures other than cabinets, such as, for example, brackets, frames, racks, etc. Further, of course, the universal drawer slides 10 may be used with extending systems and storage systems other than cabinets.

Figure 3:
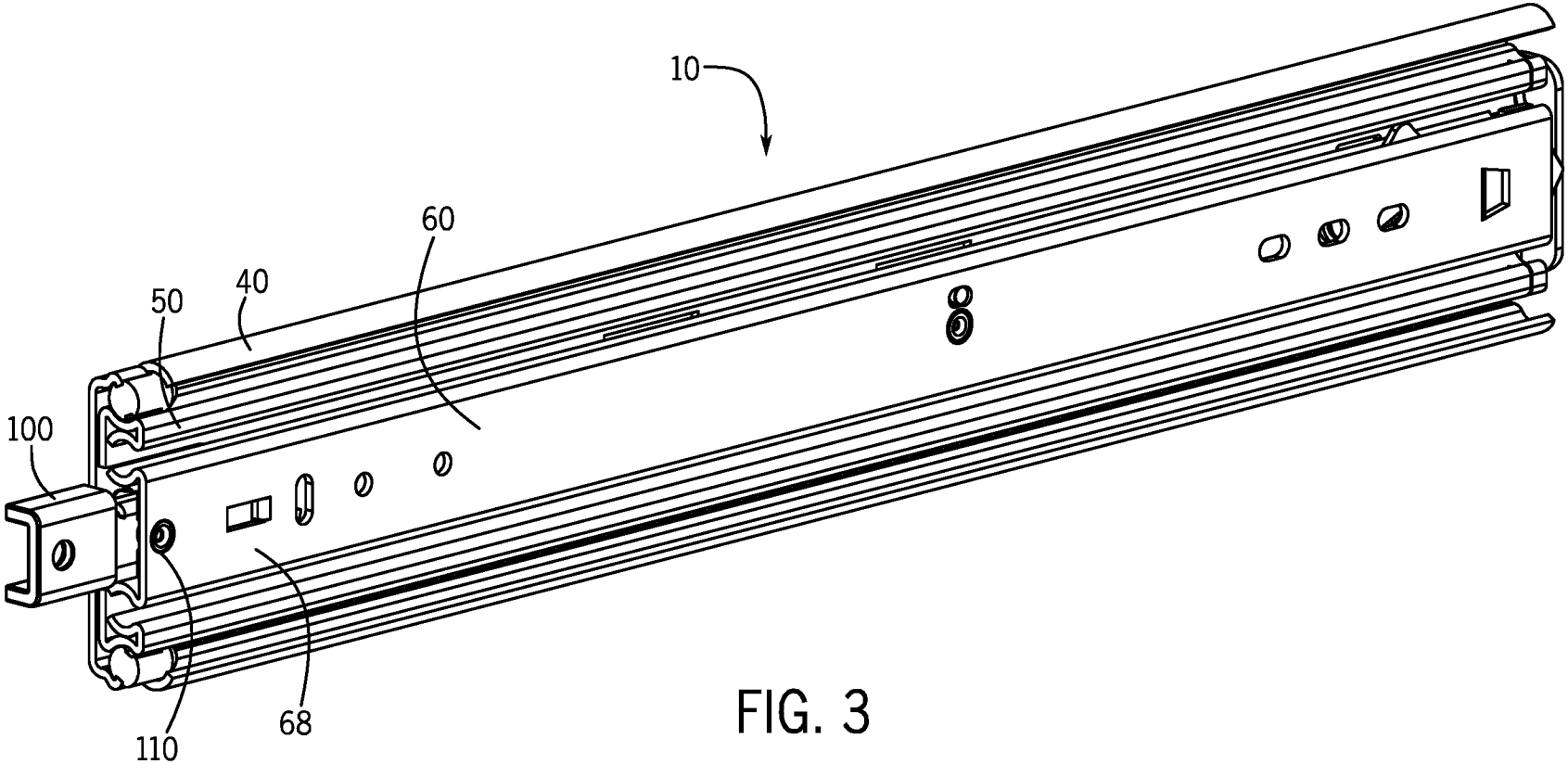
FIG. 3 is a perspective view of the universal drawer slide in the closed position.

The universal drawer slides 10 include bearings or other sliding mechanisms positioned between the outer slide member 40, the middle slide member 50, and the inner slide member 60 to provide for the drawer slides 10 to extend to an open position and to retract to a closed position. In the closed position, as shown in FIG. 3, the inner slide member 60 may nest at least partially within the middle slide member 50, and the combination of the inner slide member 60 and the middle slide member 50 may nest at least partially within the outer slide member 40.

Figure 4:
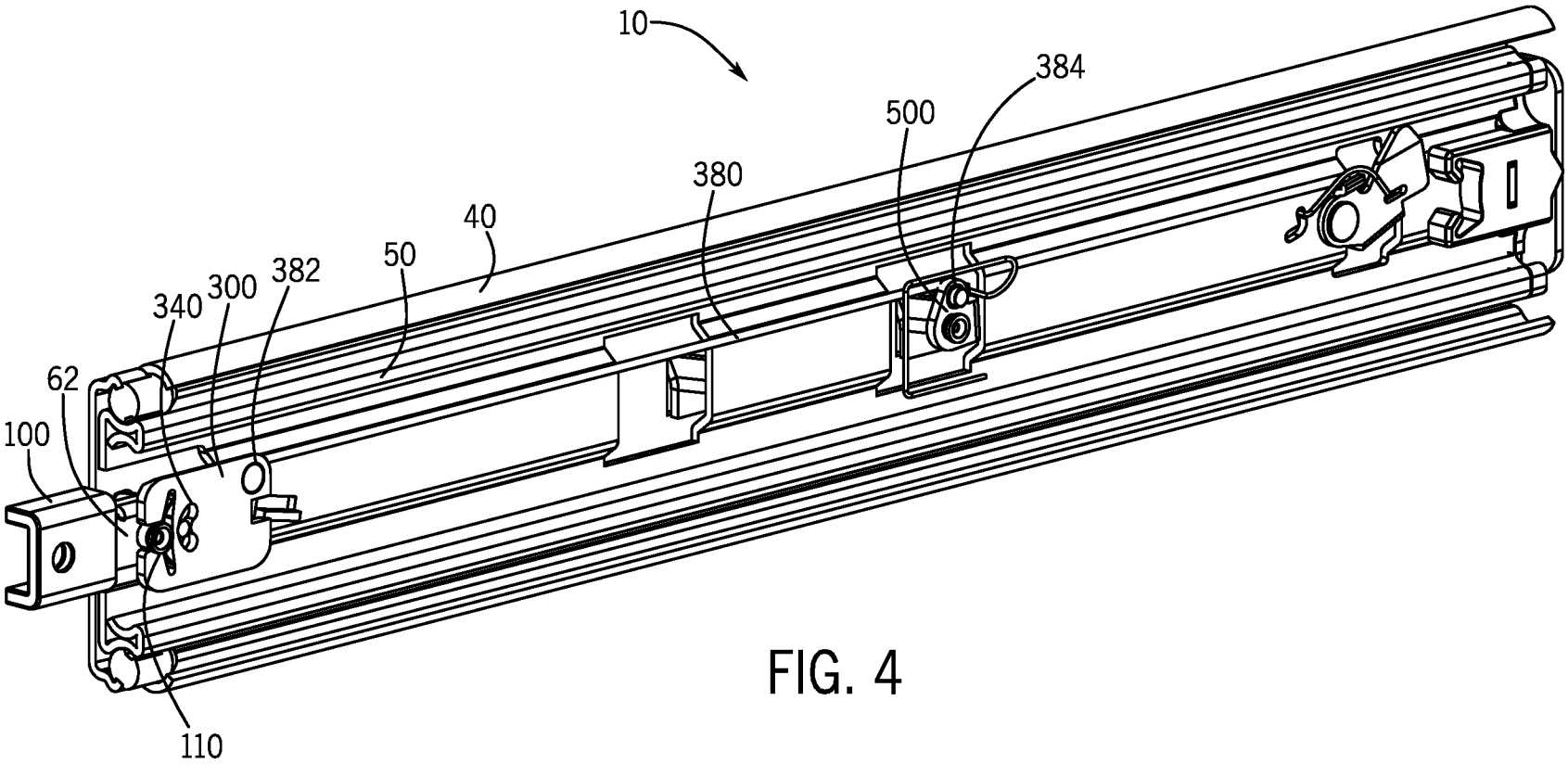
FIG. 4 is a perspective view of the universal drawer slide in the closed position with the cover of the inner slide member removed.
Figure 5:
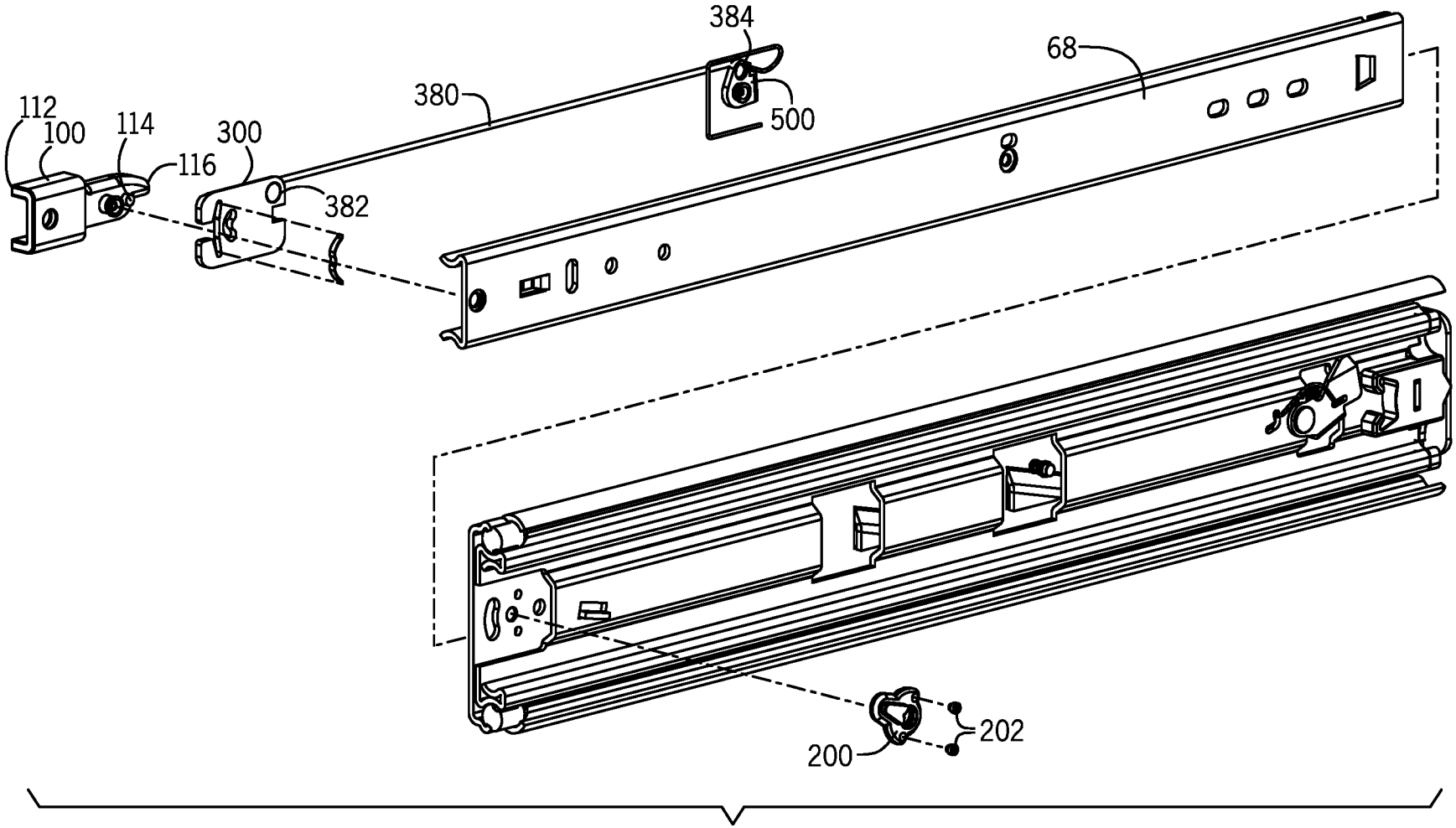
FIG. 5 is an exploded view of the universal drawer slide.

With respect to FIGS. 4 and 5, a front portion 62 of the inner slide member 60 includes a lever 100. In FIG. 5, a cover portion 68 of the inner slide member 60 is removed in order to view internal features of the inner slide member 60. The lever 100 is pivotally mounted to the inner slide member 60 by a pivot 110. The lever 100 may rotate or pivotally move about the pivot 110. The lever 100 includes a handle 112, a knob 114, and an engaging end 116. The handle 112 is generally opposite of the engaging end 116, with the knob 114 between the handle 112 and the engaging end 116.

Figure 19:
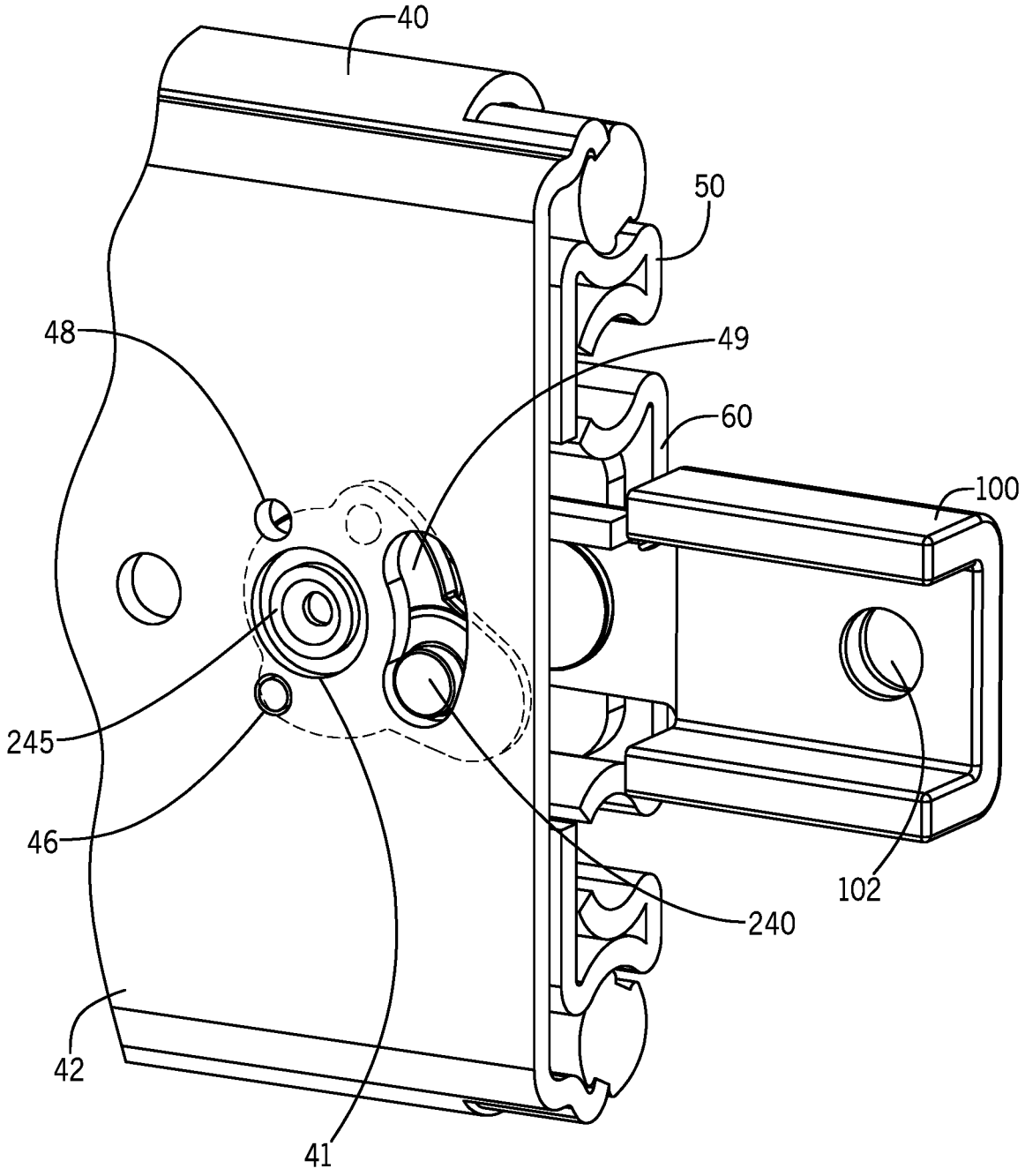
FIG. 19 is a view of the cam mounting to the outer slide member.

With respect to FIG. 19, the lever 100 may include an opening 102. With respect to FIG. 1, handle ends 37 may attach or engage to the levers 100 at the opening 102. The handle ends 37 may attach or engage to a handle 33. The handle 33 spans a distance between opposite levers 100 on the drawer 30. The user may simultaneously actuate both levers 100 by actuating the handle 33. This provides convenient one-handed opening of the drawer 30.

Figure 12:
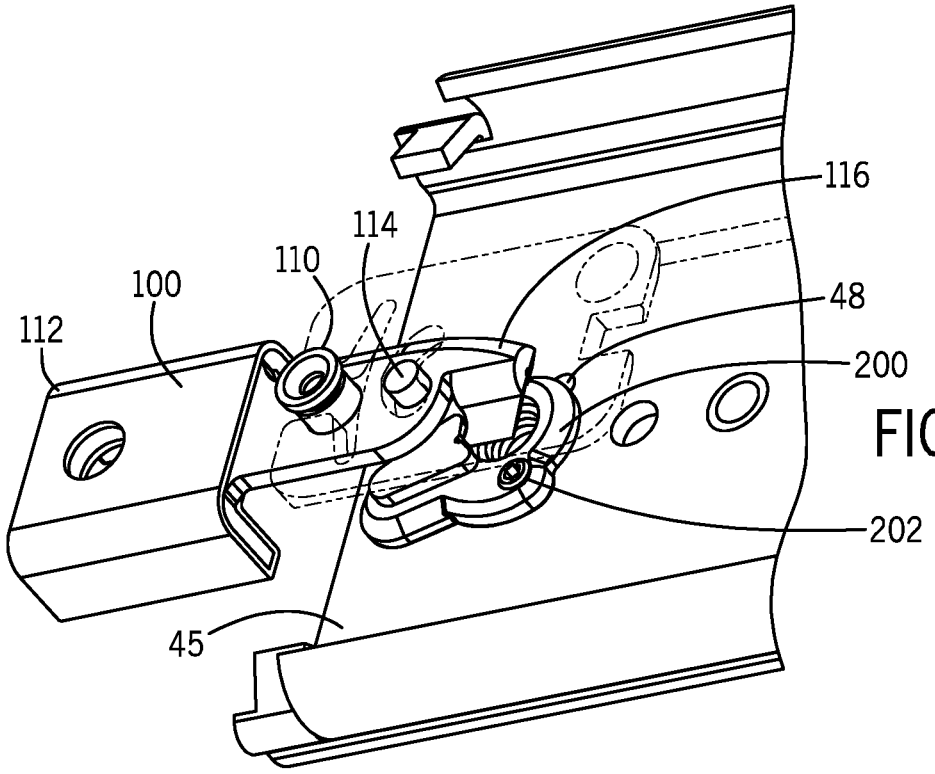
FIG. 12 is a perspective view showing the engagement of the lever to the cam.
Figure 13:
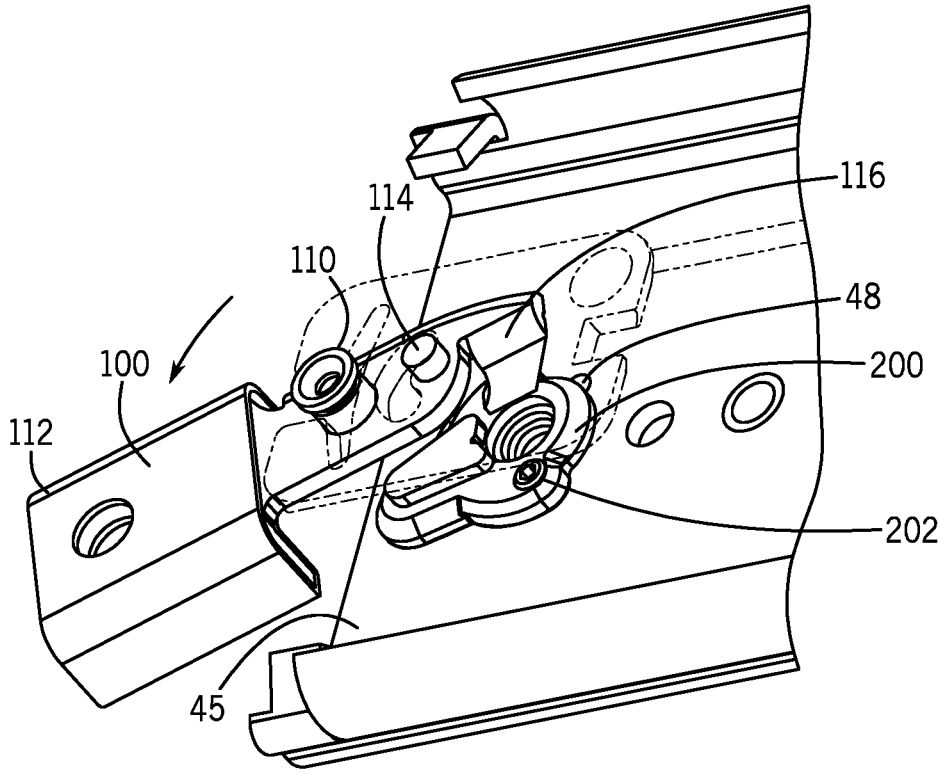
FIG. 13 is a perspective view showing the disengagement of the lever from the cam.
Figure 14:
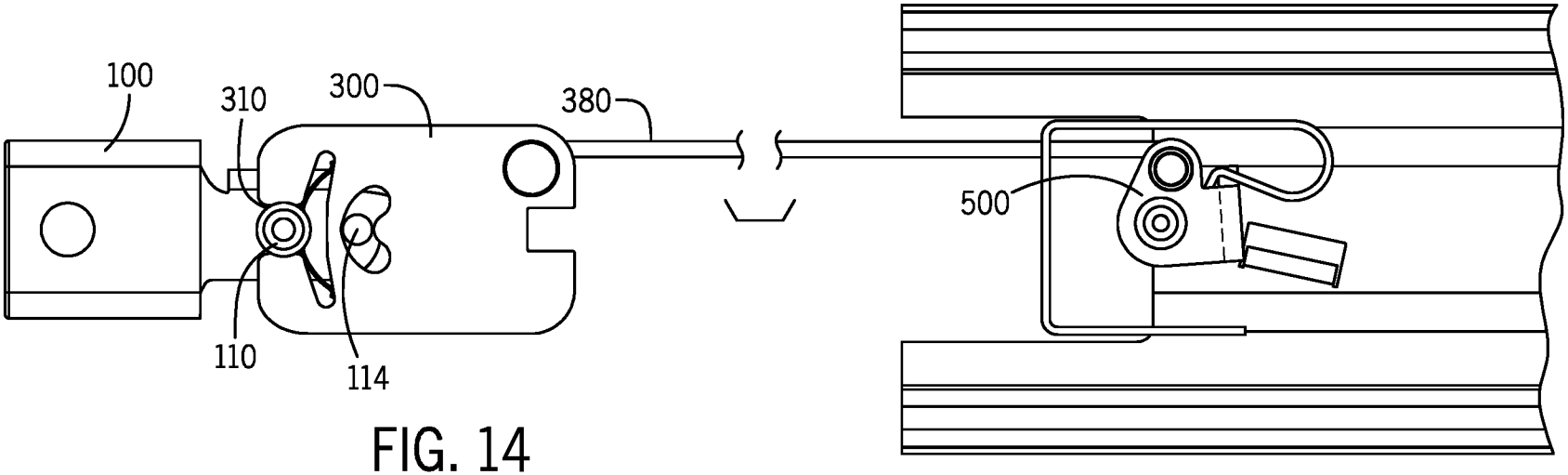
FIG. 14 is a view of the slide plate engaged to a locking mechanism of the drawer slide.
Figure 15:
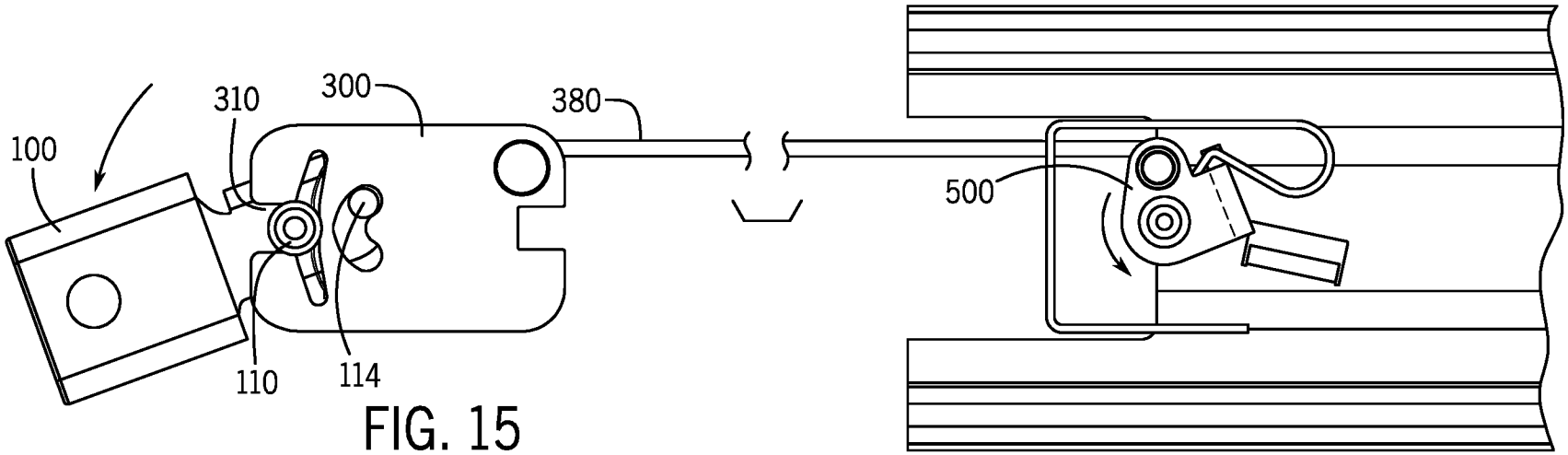
FIG. 15 is a view of lever moving downward to pull the slide plate to disengage the locking mechanism of the drawer slide.
Figure 16:
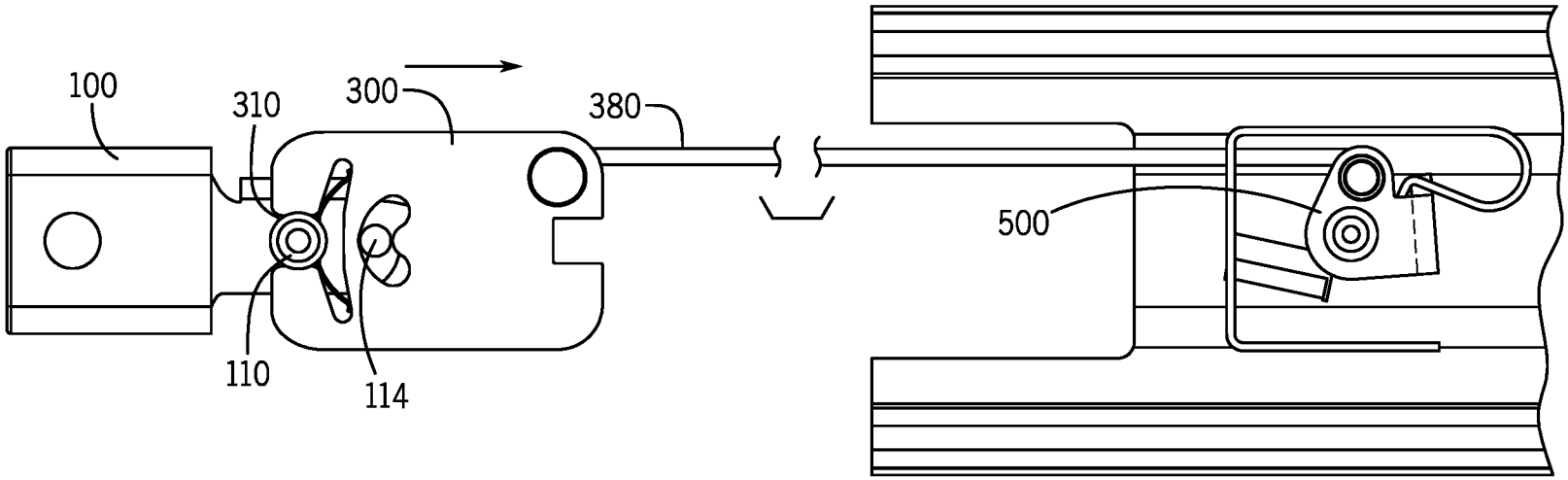
FIG. 16 is a view of the disengaged locking mechanism of the drawer slide.

With respect to FIGS. 12 and 13, the engaging end 116 of the lever 100 engages and disengages with the cam 200. The cam 200 is positioned on a front portion 45 of the outer slide member 40. Thus, the lever 100 locks the inner slide member 60 to the outer slide member 40. With respect to FIGS. 17 and 18, the cam 200 includes a first cam surface 210 and second cam surface 220 that interact with the engaging end 116 of the lever 100. The cam 200 further includes a groove 230 between the first cam surface 210 and the second cam surface 220.

Figure 18:
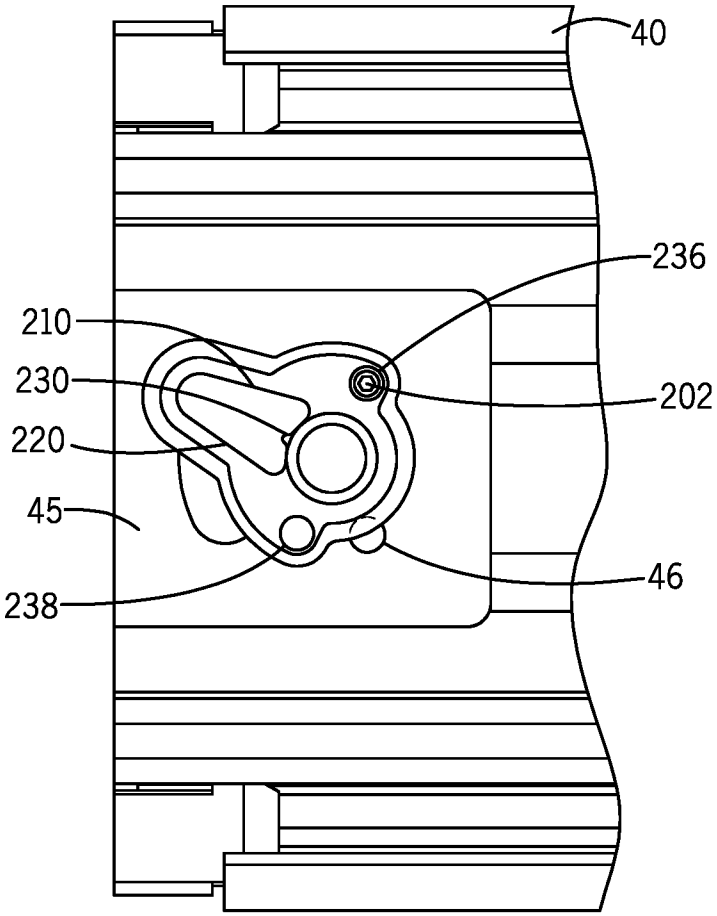
FIG. 18 is a view of the cam mounted to the drawer slide in a second direction.
Figure 17:
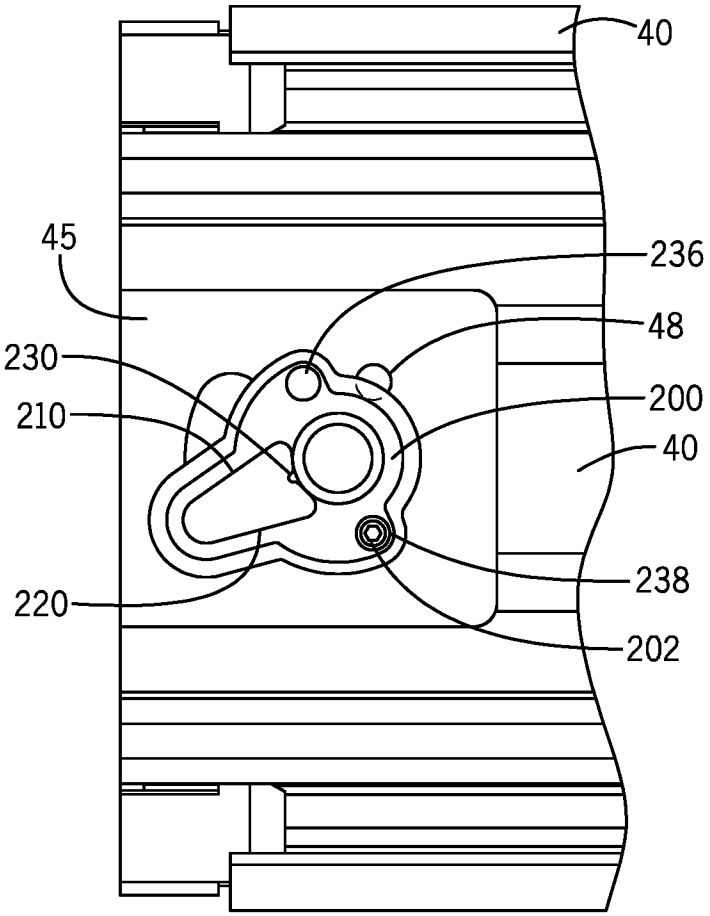
FIG. 17 is a view of the cam mounted to the drawer slide in a first direction.

With respect to FIGS. 17 and 18, the cam 200 further includes a first opening 236 and a second opening 238 that receive a fastener 202 to affix the cam 200 to the outer slide member 40. The cam 200 may be rotated or pivoted relative to the front portion 45 of the outer slide member 40 and then affixed to the front portion 45 depending upon whether the handle 112 is moved in a downward or upward direction. The front portion 45 includes a first opening 46 and a second opening 48. The operator may install the cam 200 to either of the first opening 46 or the second opening 48 depending upon whether the handle 112 is moved in a downward or upward direction.

Figure 8:
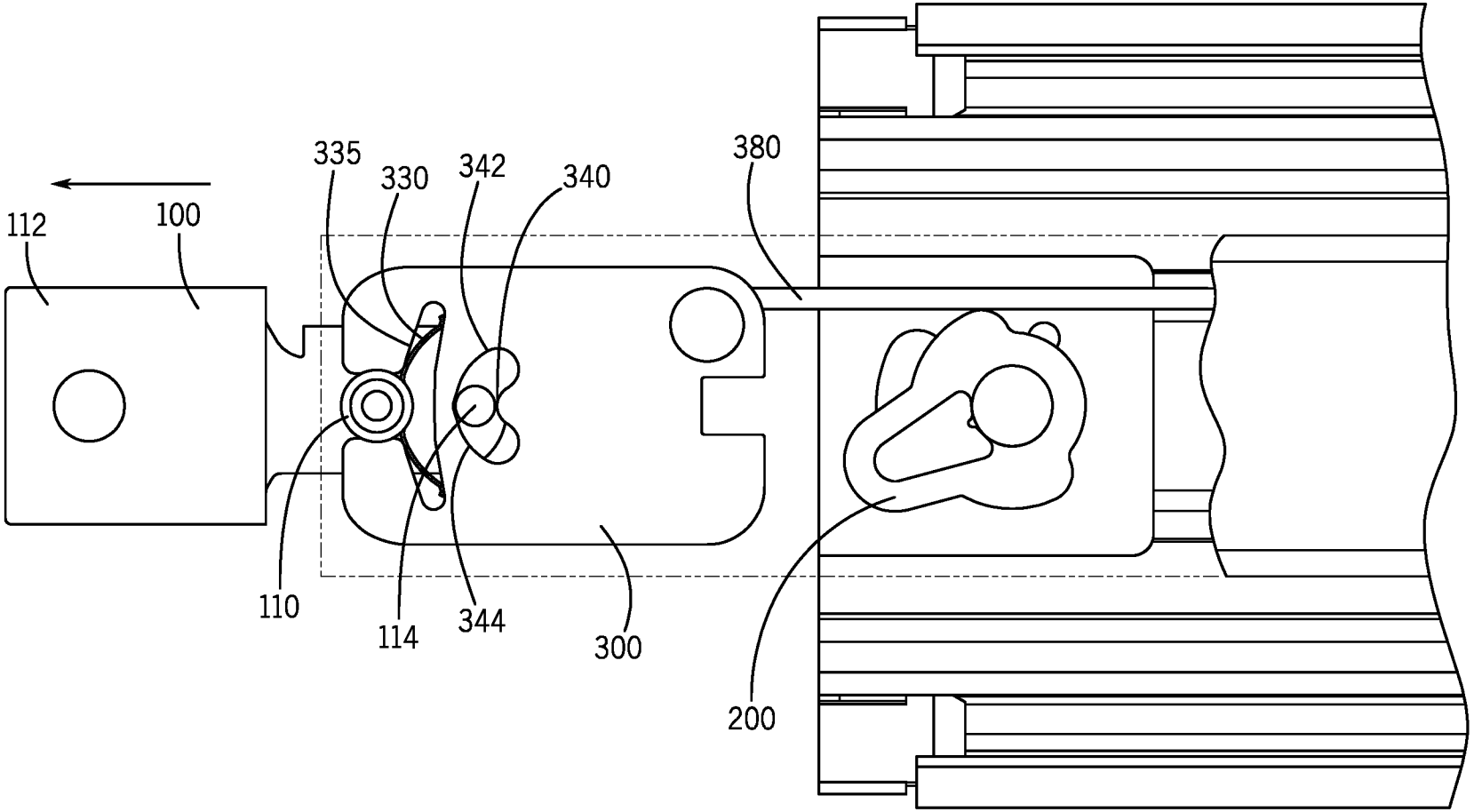
FIG. 8 is a view of the drawer slide of FIGS. 6 and 7 moving to the open position.

With respect to FIG. 8, a slide plate 300 is movably mounted to the inner slide member 60. With respect to FIGS. 14-16, the slide plate 300 includes a linear channel 310 to receive the pivot 110. A spring 330 is held in an opening 335 of the slide plate 300. The spring 330 biases against the pivot 110 to urge the slide plate 300 in an outward direction. The slide plate 300 further includes a curved channel 340 to receive the knob 114 of the lever 100. The curved channel 340 limits a range of motion that the lever 100 may rotate. The curved channel 340 includes a first curved portion 342 and a second curved portion 344. With respect to FIGS. 4 and 5, a first end 382 of a control link 380 is fixedly engaged to the slide plate 300. A second end 384 of the control link 380 engages to a locking mechanism 500 of the drawer slide 10.

During opening, the actuation of the handle 112 of the lever 100 will move the engaging end 116 to release the engaging end 116 from the first cam surface 210 or the second cam surface 220 of the cam 200. The cam 200 is affixed to the outer slide member 40. Once the engaging end 116 is released from the cam 200, the inner slide member 60 is free to move relative to the outer slide member 40 and the middle slide member 50.

Figure 6:
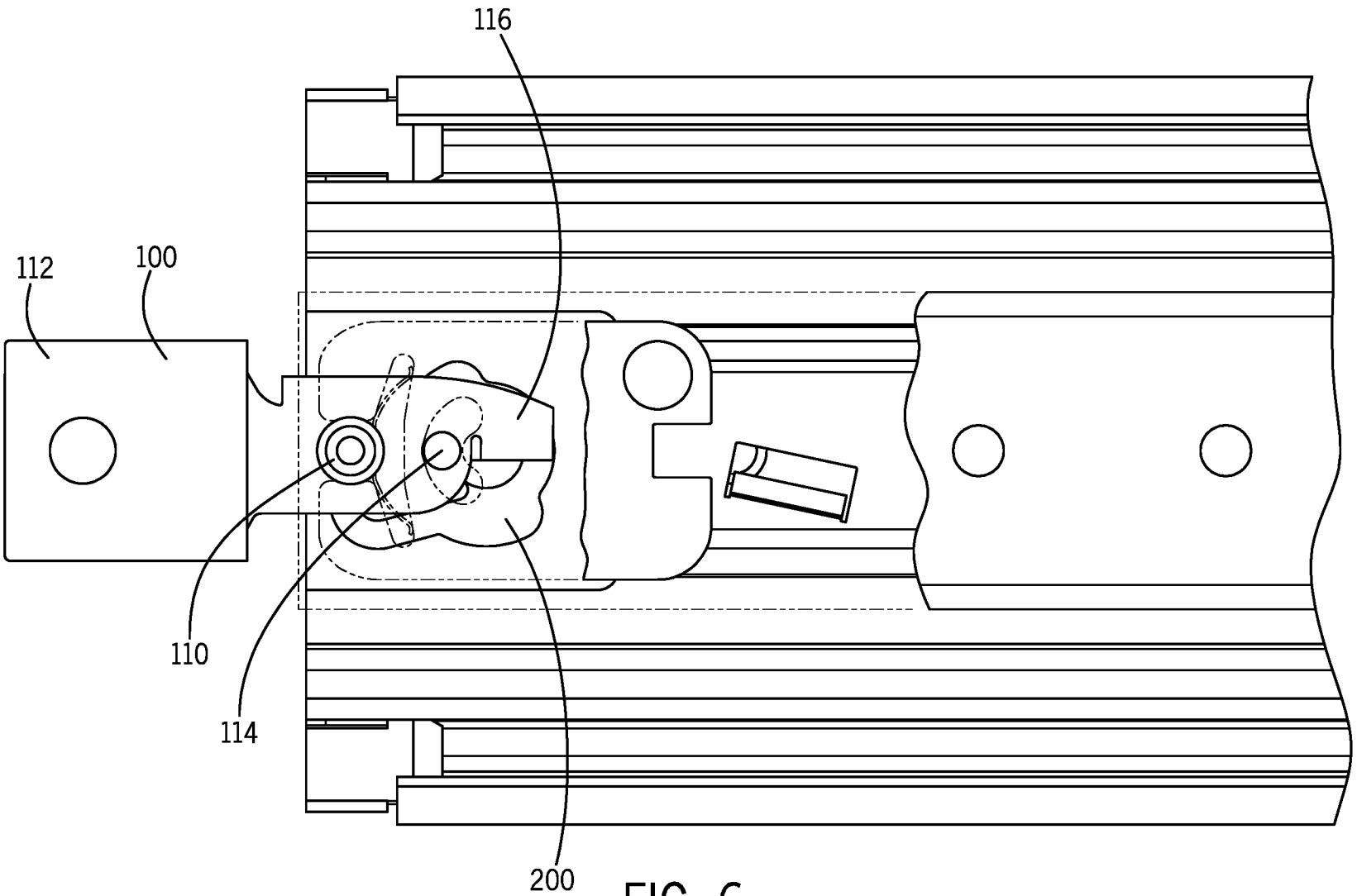
FIG. 6 is a view of the lever prior to moving in the downward direction.
Figure 7:
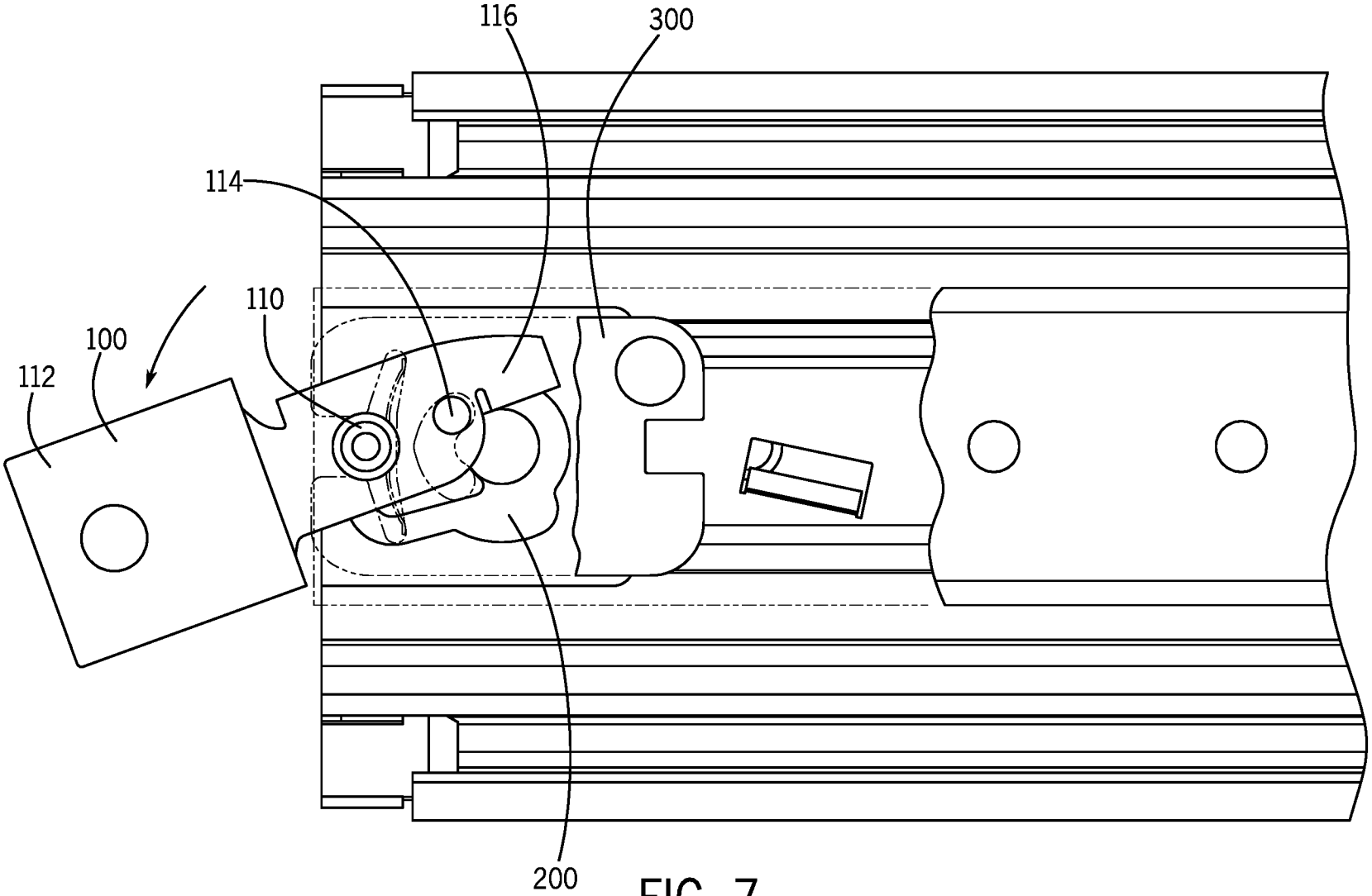
FIG. 7 is a view of the lever to moving in the downward direction.
Figure 9:
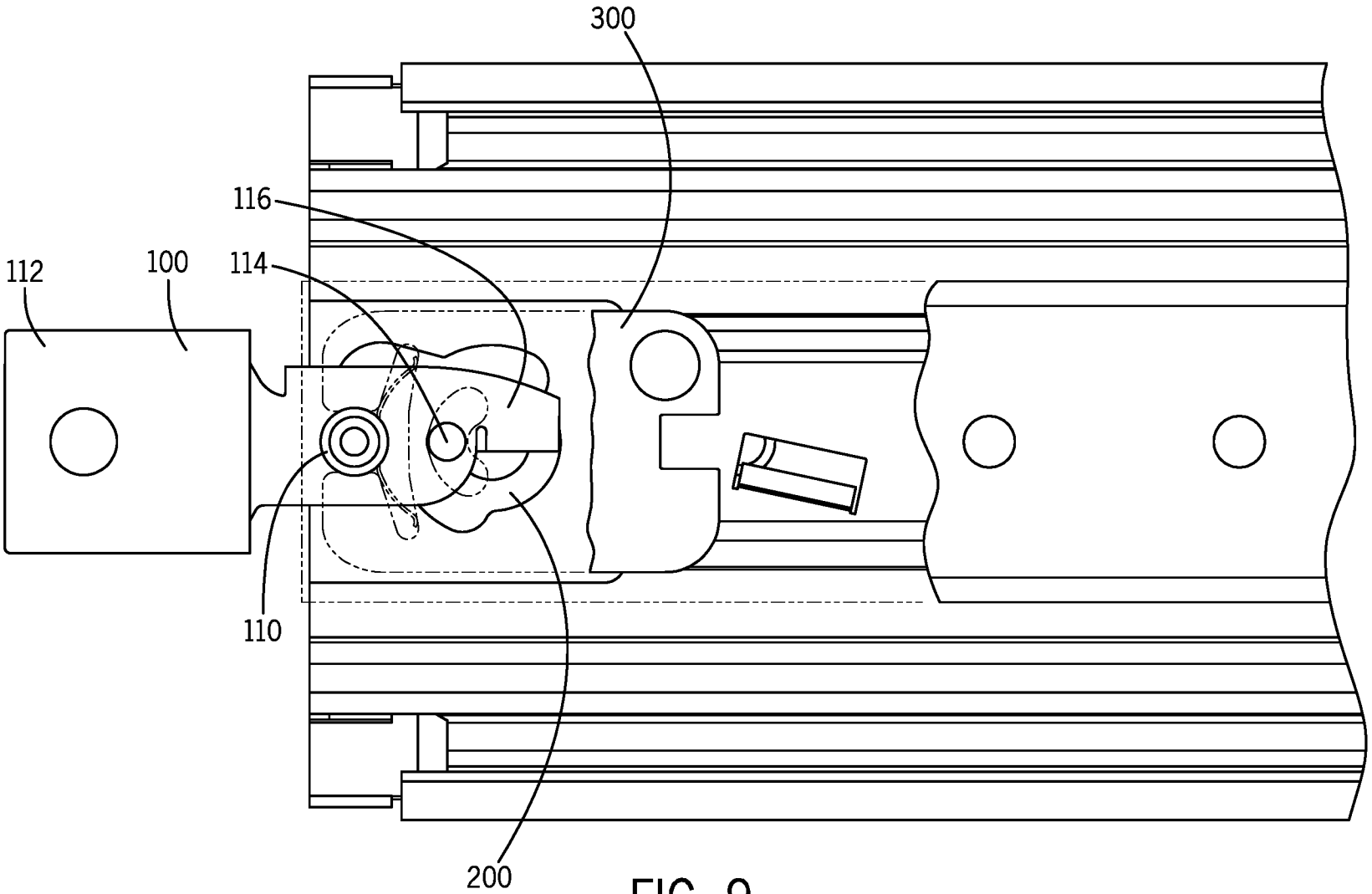
FIG. 9 is a view of the lever prior to moving in the upward direction.
Figure 10:
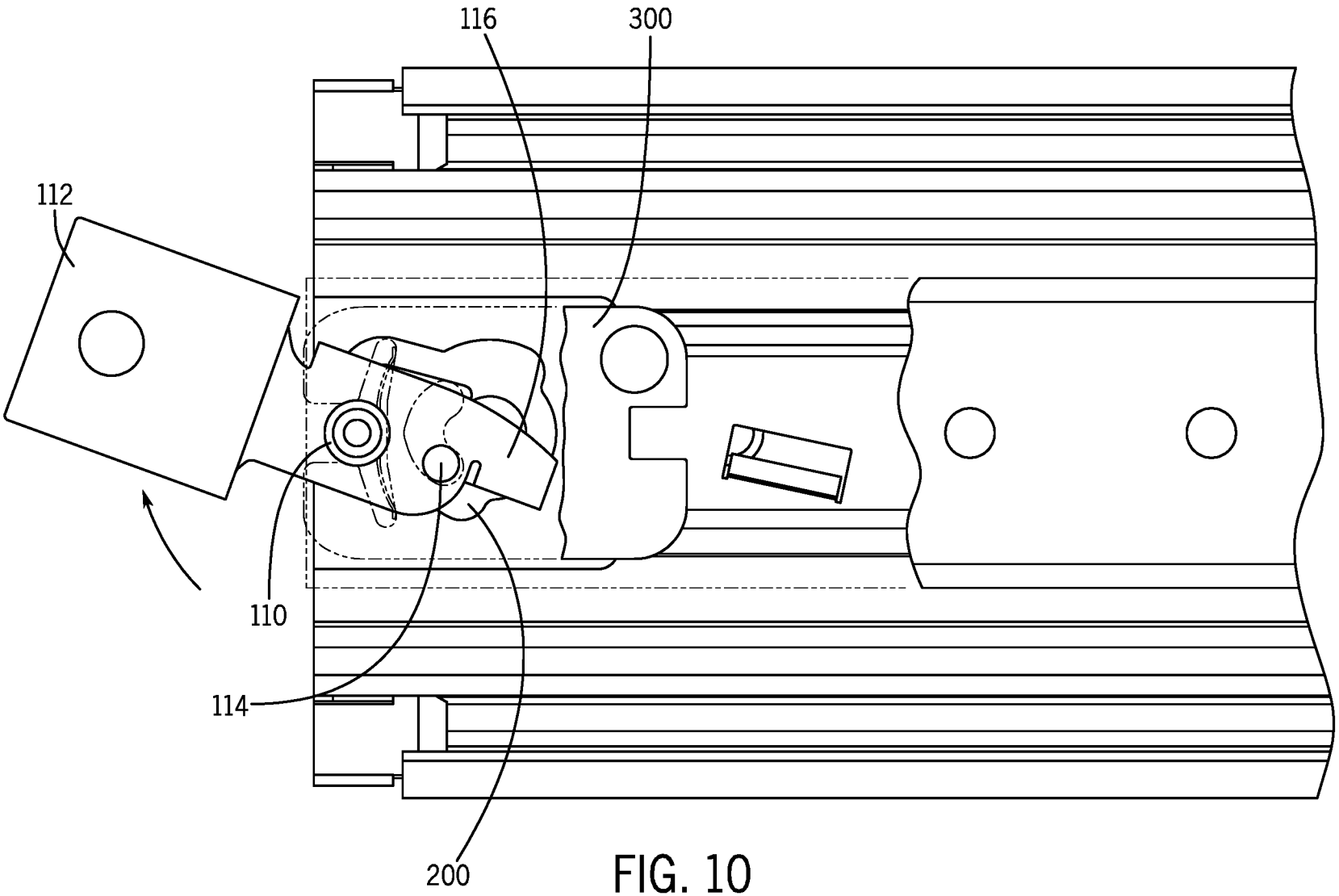
FIG. 10 is a view of the lever to moving in the upward direction.
Figure 11:
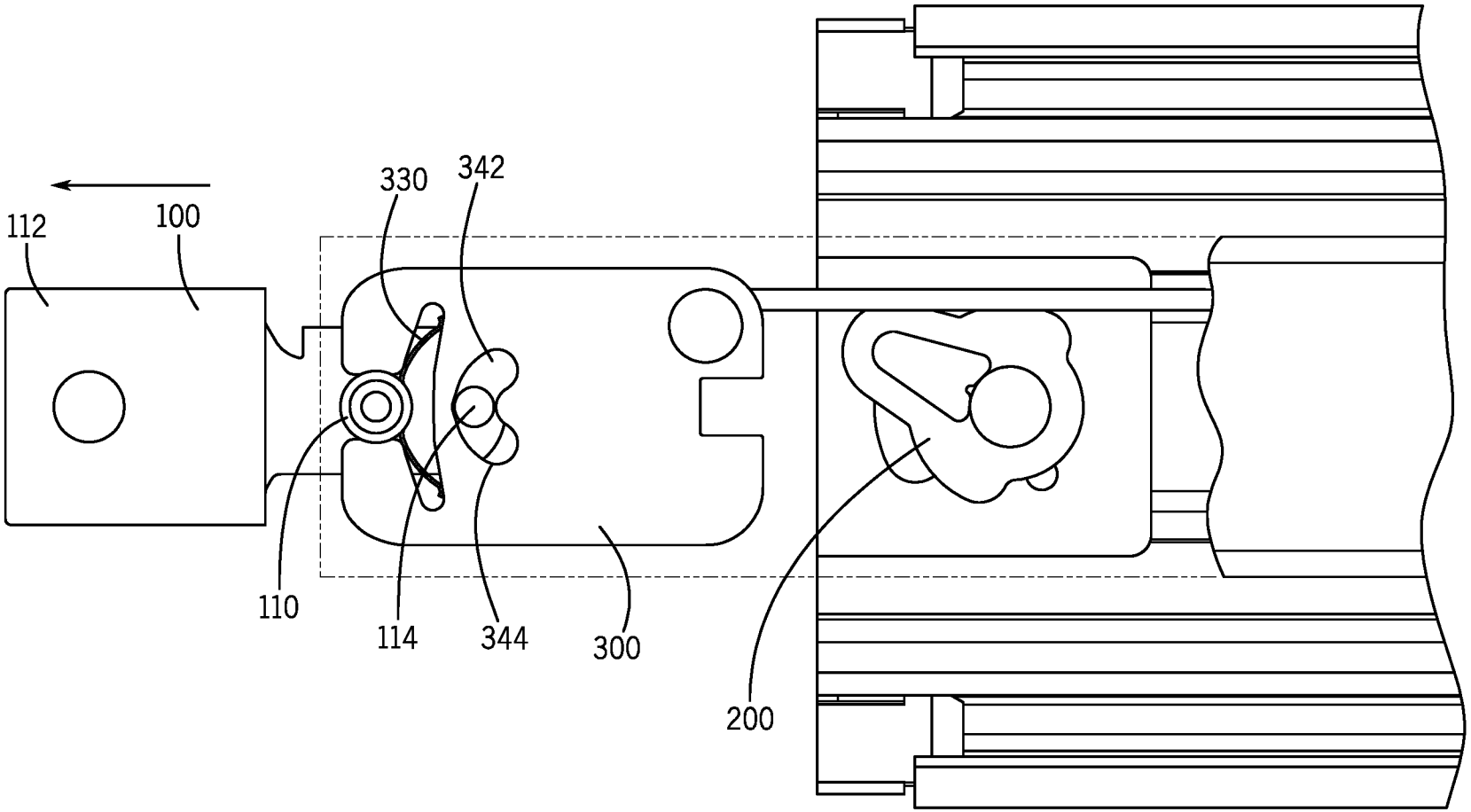
FIG. 11 is a view of the drawer slide of FIGS. 9 and 10 moving to the open position.

FIGS. 6-8 show the handle 112 moving downward to open the drawer 30. FIGS. 9-11 show the handle 112 moving upwards to open the drawer 30. In either arrangement, the movement of the handle 112 disengages the engaging end 116 from the cam 200.

The universal slide 10 may include a lock-out feature that maintains the drawer 30 in a fully open position until the locking mechanism 500 of the drawer slide 10 is released. With respect to FIGS. 14-16, during the closing of the drawer 30, the actuation of the handle 112 of the lever 100 will move the slide plate 300 sufficiently outward to pull on the control link 380, which releases the locking mechanism 500 of the drawer slide 10—to permit the drawer slide 10 to close. As such, the movement or actuation of the levers 100 will disengage the engaging end 116 from the cam 200 during an opening of the drawer 20, and, when the drawer 20 is opened, the further movement or actuation of the levers 100 will disengage the locking mechanism 500 of the drawer slide 10 in order for the drawer 20 to close. The locking mechanism 500 may hold the inner slide member 60 open relative to the outer slide member 40 and/or the middle slide member 50. In other aspects, the slide plate 300 may be engaged to other locking mechanisms of the universal slide 10 or other locking features of the cabinet 20.

The slide plate 300 may move laterally with respect to the inner slide member 60. The slide plate 300 defines the curved channel 340, which includes the first curved portion 342 and the second curved portion 344. The curved channel 340 receives the knob 114 of the lever 100. The curved channel 340 defines the range of rotation for the lever 100. The movement of the lever 100, with the knob 114 in the curved channel 340, drives the movement of the slide plate 300. Either upward or downward movement of the handle 112 will cause the slide plate 300 to move outward, i.e., away from an interior of the cabinet 10. During the movement of the slide plate 300, the linear channel 310 of the slide plate 300 moves against the pivot 100. When the lever 100 is released by the operator, the lever 100 moves back to a neutral position by the bias of the spring 330, i.e., the slide plate automatically 300 moves inward toward an interior of the cabinet 10.

During the closing of the drawer 30, the engaging end 116 of the lever 100 will be re-engaged to the respective first cam surface 210 or second cam surface 220. As the drawer 30 is closed, the engaging end 116 will contact or rub against the respective first cam surface 210 or second cam surface 220 thus compressing the spring 330. When the engaging end 116 passes an end of either the first cam surface 210 or the second cam surface 220, the engaging end 116 will snap into the groove 230 under bias from the spring 330. Thus, the inner slide member 60 is now latched or secured to outer slide member 40 and the drawer is maintained in the closed position. The engaging end 116 locks into the groove 230 regardless if the engaging end 116 is moving upwards or downwards.

As illustrated in FIGS. 1-18, a pair of drawer slides 10 may be used on either side of the drawer 30 of the cabinet 10 by merely adjusting the position of the cam 200 on one of the drawer slides 10. The drawer slide 10 is configured to be used on the left side of the drawer 30 or on the right side of the drawer 30 by mounting the cam 200 to the outer slide member 40 in either the first position or the second position. The engaging end 116 moves in a first direction, such as upwards, to engage with the cam 200 in the first position, and the engaging end 116 moves in a second direction, such as downwards, to engage with the cam 200 in the second position.

In order to adjust the drawer slide 10 between left side or right side usage, the fastener 202 is passed through either the first opening 236 or the second opening 238 of the cam 200 and into either the first opening 46 or the second opening 48 in the outer slide member 40. The movement of the cam 200 to orientate the first opening 236 or the second opening 238 of the cam 200 with the first opening 46 or the second opening 48 in the outer slide member 40 provides for the cam 200 to be at same angle as the opposing cam 200, which provides for both cams 200 to operate with upward or downward movement of the lever 100. This provides an easy and efficient installation of the universal drawer slide 10.

With respect to FIGS. 17-19, the front portion 45 includes the first opening 46 and the second opening 48. The operator may install the cam 200 to either the first opening 46 (for upward movement of the engaging end 116) or the second opening 48 (for downward movement of engaging end 116) depending upon whether the handle 112 is moved in a downward or upward direction to engage the cam 200. The difference between installing the cam 200 to either of the first opening 46 or the second opening 48 rotates the cam 200 by approximately 40 degrees to approximately 60 degrees. In FIG. 17, the fastener 202 is in the second opening 238 of the cam 200 and passes into the first opening 46. The first opening 236 of the cam 200 is empty. In FIG. 18, the cam 200 has been rotated upward, and the fastener 202 is in the first opening 236 of the cam 200 and passes into the second opening 48, and the second opening 238 of the cam 200 is empty.

With respect to FIG. 19, and as described above, the cam 200 may be rotated or pivoted relative to the front portion 45 of the outer slide member 40 and then affixed to the front portion 45 depending upon whether the handle 112 is moved in a downward or an upward direction. The cam 200 is rotatably or pivotally mounted at an opening 41 of the outer slide member 40. A rear surface of the cam 200 includes a cam pivot 245 rotatably or pivotally engaged to the opening 41 of the outer slide member 40. The rear surface of the cam 200 includes a cam positioner 240 that moves in a curved opening 49 in the outer slide member 40. The curved opening 49 defines a range of motion for the cam positioner 240. The curved opening 49 provides limits to the motion of the cam positioner 240, and thus the cam 200. The interaction of the cam positioner 240 with the curved opening 49 prevents over-rotation of the cam 200. In a vertical installation, the force of gravity may move the cam 200 to a downward facing positioner, such as shown in FIGS. 17 and 19, and the fastener 202 is not required to maintain the cam 200 in the downward position. Of course, fastener 202 may be used anyway, such as shown in FIGS. 17 and 19. In FIG. 18, the cam 200 is in an upward facing position, and the fastener 202 is used to maintain the upward facing position.

FIGS. 17-19 show vertical installations of the drawer slide 10. In horizontal installations (not shown), where the cam 200 is on an upward or lower facing surface of the drawer slide 10, the fastener 202 may be needed to maintain proper position of the cam 200. In such horizontal installations, the cam 200 may be fixed in either the first or second positions.

As such, it should be understood that the disclosure is not limited to the particular aspects described herein, but that various changes and modifications may be made without departing from the spirit and scope of this novel concept as defined by the following claims. Further, many other advantages of applicant's disclosure will be apparent to those skilled in the art from the above descriptions and the claims below.

What is claimed is:

1. A drawer slide, comprising:

an outer slide member and an inner slide member configured to move between a closed position and an extended position;

a lever is pivotally mounted to a front portion of the inner slide member;

a cam configured to mount to the outer slide member in a first position and a second position, and the cam includes a first cam surface and second cam surface;

the lever includes an engaging end that engages with the first cam surface or the second cam surface to secure the inner slide member to the outer slide member; and, wherein the drawer slide is configured to be used on a left side of a drawer or on a right side of the drawer by mounting the cam member to the outer slide member in either the first position or the second position.

2. The drawer slide according to claim 1, wherein the lever moves in a first direction to engage the first cam surface in the first position, and the lever moves in a second direction to engage the second cam surface in the second position.

3. The drawer slide according to claim 1, wherein a groove is positioned between the first cam surface and the second cam surface, wherein the engaging end is configured to lock into the groove.

4. The drawer slide according to claim 1, wherein the lever engages a slide plate of the inner slide member, and the slide plate releases a locking mechanism of the drawer slide to allow the drawer slide to close.

5. The drawer slide according to claim 1, further comprising a middle slide member between the inner slide member and the outer slide member.

6. The drawer slide according to claim 1, wherein the lever includes a handle, a knob, and the engaging end, wherein the handle is generally opposite of the engaging end, wherein the knob is in between the handle and the engaging end.

7. The drawer slide according to claim 1, wherein the lever is pivotally mounted to the inner slide member by a pivot.

8. The drawer slide according to claim 7, wherein a slide plate is movably mounted to the inner slide member, and the slide plate includes a linear channel to receive the pivot.

9. The drawer slide according to claim 8, wherein a spring is held in an opening of the slide plate, and the spring biases against the pivot to urge the slide plate in an outward direction.

10. The drawer slide according to claim 8, wherein a first end of a control link is fixedly engaged to the slide plate, and a second end of the control link engages to a locking mechanism of the drawer slide.

11. The drawer slide according to claim 1, wherein the lever is pivotally mounted to the inner slide member by a pivot, wherein a slide plate is movably mounted to the inner slide member, and the slide plate includes a channel to receive the pivot.

12. The drawer slide according to claim 11, wherein the slide plate further includes a curved channel to receive a knob of the lever.

13. The drawer slide according to claim 12, wherein the curved channel includes a first curved portion and a second curved portion, and the curved channel limits a range of motion that the lever may rotate.

14. The drawer slide according to claim 1, wherein the lever includes a handle, a knob, and the engaging end, wherein the handle is generally opposite of the engaging end, wherein the knob is between the handle and the engaging end, wherein the engaging end is configured to move upwards or downwards to engage the cam.

15. The drawer slide according to claim 1, wherein the cam is adjustable to mount to the outer slide member in the first position or the second position.

16. The drawer slide according to claim 1, wherein the cam is adjustable to mount to the outer slide member in the first position or the second position by operation of gravity or by attaching the cam to the outer slide member.

17. A cabinet comprising the drawer and the drawer slide according to claim 1, wherein the drawer slide is engaged to both the drawer and the cabinet, wherein the drawer slide is configured to be used on the left side of the drawer or on the right side of the drawer by mounting the cam member to the outer slide member in either the first position or the second position.

18. A cabinet comprising the drawer and the drawer slide according to claim 1, wherein the drawer slide is engaged to both the drawer and the cabinet, wherein the drawer slide is configured to be used on the left side of the drawer or on the right side of the drawer by mounting the cam member to the outer slide member in either the first position or the second position, wherein the engaging end moves in a first direction to engage with the cam in the first position, and the engaging end moves in a second direction to engage with the cam in the second position, wherein the second direction is generally opposite of the first direction.

19. A cabinet comprising the drawer and the drawer slide according to claim 1, wherein the drawer slide is engaged to both the drawer and the cabinet.

20. A storage system comprising the drawer slide according to claim 1, wherein the drawer slide is engaged to both the drawer and the storage system.

21. A drawer slide, comprising:

an outer slide member and an inner slide member configured to move between a closed position and an extended position;

a lever is pivotally mounted to a front portion of the inner slide member;

a cam configured to mount to the outer slide member in a first position and a second position, and the cam includes a first cam surface and second cam surface;

the lever includes an engaging end that engages with the first cam surface when the cam is mounted in the first position or engages with the second cam surface when surface when the cam is mounted in the second position; and, the engagement of the engaging end to the first cam surface or the second cam surface cam secures the inner slide member to the outer slide member.

22. The drawer slide member according to claim 21, wherein the drawer slide is engaged to a movable storage member, wherein the movable storage member is a drawer, a tray, a panel, a sliding member, or a storage member.

23. The drawer slide according to claim 22, wherein the drawer slide is engaged to the drawer, the tray, the panel, the sliding member, or the storage member and the drawer slide is also engaged to a storage system or a cabinet.

24. A drawer slide, comprising:

a first slide member and a second slide member configured to move between a closed position and an extended position;

a lever is pivotally mounted to a front portion of the second slide member;

a cam configured to mount to the first slide member in a first position and a second position;

the lever includes an engaging end that engages with the cam to secure the first slide member to the second slide member; and, wherein the lever moves in a first direction to engage the cam in the first position, and the lever moves in a second direction to engage the cam in the second position.

25. A drawer slide, comprising:

a first slide member and a second slide member configured to move between a closed position and an extended position;

a lever is mounted to a front portion of the second slide member;

a cam configured to mount to the first slide member in a first position and a second position, and the cam includes a first cam surface and second cam surface;

the lever includes an engaging end that engages with the first cam surface or the second cam surface to secure the second slide member to the first slide member; and, wherein the drawer slide is configured to be used on a left side of a drawer or on a right side of the drawer by mounting the cam member to the first slide member in either the first position or the second position.

26. A drawer slide, comprising:

a first slide member and a second slide member configured to move between a closed position and an extended position;

a lever is mounted to the second slide member;

a cam configured to mount to the first slide member in a first position and a second position;

the lever includes an engaging end that engages with the cam to secure the first slide member to the second slide member; and, wherein the lever moves in a first direction to engage the cam in the first position, and the lever moves in a second direction to engage the cam in the second position.

* * * * *